US008146308B2

(12) United States Patent
Warnecke et al.

(10) Patent No.: US 8,146,308 B2
(45) **Date of Patent: *Apr. 3, 2012**

(54) FLOOR DRAIN SUPPORT PLATE

(75) Inventors: Lawrence Warnecke, Ladner (CA); Carl R. Nicolia, Erie, PA (US); Donald A. Kubiak, Erie, PA (US); Christopher A Majocka, Erie, PA (US)

(73) Assignee: Zurn Industries, LLC, Erie, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/904,370

(22) Filed: Oct. 14, 2010

(65) Prior Publication Data

US 2011/0023229 A1 Feb. 3, 2011

Related U.S. Application Data

(63) Continuation of application No. 11/012,894, filed on Dec. 15, 2004, now Pat. No. 7,997,038.

(60) Provisional application No. 60/532,058, filed on Dec. 23, 2003.

(51) Int. Cl.
*E04B 1/70* (2006.01)

(52) U.S. Cl. ..... 52/302.3; 52/741.1; 210/164; 285/44

(58) Field of Classification Search ..... 52/302.3, 52/219, 220.8, 741.1; 210/163, 164, 165, 210/166; 285/42, 43, 44
See application file for complete search history.

(56) References Cited

U.S. PATENT DOCUMENTS

| | | | | |
|---|---|---|---|---|
| 228,091 | A | 5/1880 | Lowell | |
| 412,195 | A | 10/1889 | Marker | |
| 598,992 | A | 2/1898 | Hosford | |
| 645,749 | A * | 3/1900 | Kasschau | 4/287 |
| 1,059,671 | A | 4/1913 | Holt | |
| 1,123,750 | A | 1/1915 | Kane | |
| 1,275,922 | A | 8/1918 | Holt | |
| 1,299,423 | A | 4/1919 | Bropson | |
| 1,348,945 | A | 8/1920 | Hirshstein | |
| 1,503,421 | A | 9/1921 | Innes | |
| 1,434,254 | A | 10/1922 | Sanders | |
| 1,538,433 | A | 5/1923 | Hirshstein | |
| 1,532,897 | A | 7/1924 | Hirshstein | |
| 1,538,924 | A * | 5/1925 | Boosey | 210/163 |

(Continued)

OTHER PUBLICATIONS

Website pp. 1 and 2 for floor drains manufactured by Zurn Industries, Inc., retrieved from www.zurn.com, 2003.

(Continued)

*Primary Examiner* — Brian Glessner
*Assistant Examiner* — Adriana Figueroa
(74) *Attorney, Agent, or Firm* — The Webb Law Firm

(57) ABSTRACT

A drain support plate adapted to fasten to a receptacle body of a drain. The support plate includes a body having an inner surface and an outer surface and defining a first portion and a second portion. The first portion of the body defines a peripheral edge and the second portion of the body is attached to the peripheral edge of the first portion and axially extends therefrom. The inner surface of the first portion and the second portion of the body define an interior cavity. The first portion of the body defines a center passageway spaced radially apart from the peripheral edge and is adapted to receive a pipe. The first portion of the body defines at least one slot adapted to be aligned with the receptacle body for receiving a member for attaching the receptacle body to the body of the support plate.

8 Claims, 3 Drawing Sheets

U.S. PATENT DOCUMENTS 1,690,630 A 2/1926 Fleming
1,584,986 A 5/1926 Fleming
1,669,586 A * 5/1928 Boosey ..... 210/165
1,731,617 A 10/1929 Fleming
1,733,254 A * 10/1929 Fleming ..... 210/165
1,746,775 A 2/1930 Johnson et al.
1,749,878 A 3/1930 Fleming
1,753,262 A 4/1930 Cromwell
1,761,257 A 6/1930 Fleming
1,762,838 A 6/1930 Shand
1,786,558 A * 12/1930 Boosey ..... 210/165
1,802,481 A 4/1931 Shand
1,805,816 A 5/1931 Fleming
1,809,413 A 6/1931 Hirshstein
1,828,601 A 10/1931 Frye
1,873,275 A 8/1932 Boosey
1,905,856 A 4/1933 Haase et al.
1,918,509 A 7/1933 Wilcox
1,941,537 A 1/1934 Boosey
1,963,300 A 6/1934 Fleming
1,972,513 A 9/1934 Drehmann
1,973,304 A 9/1934 Boosey
1,991,130 A 2/1935 Warren
1,991,772 A 2/1935 Rieger et al.
1,999,277 A 4/1935 Boosey
2,019,779 A 11/1935 Fleming
2,079,269 A 5/1937 Williams
2,091,927 A 8/1937 Hirshstein
2,121,220 A 6/1938 Filkins
2,127,167 A 8/1938 Fraters
2,142,343 A 1/1939 Boosey
2,191,686 A 2/1940 Shenk
2,202,147 A 5/1940 Gerriets
2,222,807 A 11/1940 Burr
2,283,160 A 5/1942 Boosey
2,283,365 A 5/1942 Heinkel
2,284,416 A 5/1942 Gordon
2,299,705 A 10/1942 Svirsky
2,400,070 A * 5/1946 Boosey ..... 210/165
2,427,258 A * 9/1947 Silvestro ..... 210/163
2,490,075 A 12/1949 Matheis
2,497,577 A 2/1950 Biggerstaff
2,501,971 A 3/1950 Schenck
2,550,402 A 4/1951 Boosey
2,626,674 A 1/1953 Boosey
2,666,493 A 1/1954 Gordon
2,672,205 A 3/1954 McDonald
2,705,542 A 4/1955 Yavitch
2,740,490 A 4/1956 Matheis
2,743,946 A 5/1956 Schmid et al.
2,762,448 A 9/1956 Schmid et al.
2,765,865 A 10/1956 Schmid
2,783,852 A 3/1957 Sisk
2,837,212 A 6/1958 Schmid
2,881,921 A 4/1959 Baker et al.
2,888,138 A 5/1959 Baker et al.
3,095,219 A 6/1963 Tutty
3,246,582 A 4/1966 Wade et al.
3,287,742 A 11/1966 Gaddis
3,420,552 A 1/1969 Mork
3,447,329 A 6/1969 Emberson
3,469,698 A 9/1969 Blendermann
3,469,699 A 9/1969 Blendermann et al.
3,516,541 A 6/1970 Hardingham
3,529,723 A * 9/1970 Hagedorn ..... 210/163
3,674,149 A 7/1972 Donalson
3,774,765 A 11/1973 Kane et al.
3,893,919 A 7/1975 Flegel et al.
4,092,745 A 6/1978 Oropallo
4,212,486 A 7/1980 Logsdon
4,243,251 A 1/1981 Lindquist
4,423,527 A 1/1984 Morris et al.
4,433,860 A 2/1984 Lindquist
RE31,561 E 4/1984 Thompson
4,462,123 A 7/1984 Morris et al.
4,487,690 A 12/1984 Logsdon
4,492,491 A 1/1985 Lunden et al.
4,505,814 A * 3/1985 Marshall ..... 210/166
4,694,513 A 9/1987 Kiziah
4,799,713 A 1/1989 Uglow
4,943,100 A 7/1990 Emberson
4,964,180 A 10/1990 Harbeke
5,022,430 A 6/1991 Degooyer
5,141,633 A 8/1992 Walczak et al.
5,154,024 A 10/1992 Noel
5,297,817 A 3/1994 Hodges
5,299,836 A * 4/1994 Woods ..... 285/42
5,372,715 A 12/1994 Maggard et al.
5,378,356 A 1/1995 Logsdon
5,618,416 A 4/1997 Haefner
5,702,596 A 12/1997 Juple et al.
5,722,791 A 3/1998 Dallmer
5,724,777 A 3/1998 Hubbard
5,735,091 A 4/1998 Hawkins et al.
5,829,214 A 11/1998 Hart
5,966,884 A 10/1999 Uglow
6,076,559 A 6/2000 Castillo et al.
6,182,704 B1 2/2001 Bevacco
6,269,495 B1 8/2001 Sondrup
6,378,269 B1 4/2002 Wiegand, Sr.
6,381,775 B1 5/2002 Sondrup
6,594,966 B2 7/2003 Froeter
6,647,682 B2 11/2003 Bishop
6,755,966 B1 6/2004 Reed
6,766,545 B2 7/2004 Hodges
6,833,067 B2 12/2004 Dresmann
6,953,208 B2 10/2005 Warnecke
7,078,616 B2 7/2006 Roesch et al.
2003/0037498 A1 2/2003 Bishop
2003/0159384 A1 8/2003 Warnecke
2004/0200162 A1 10/2004 Wroblewski
2005/0166315 A1 8/2005 Warnecke et al.
2005/0203468 A1 9/2005 Warnecke
2008/0106094 A1 5/2008 Edelmayer

OTHER PUBLICATIONS

Installation instructions for Z-415 floor drain manufactured by Zurn Industries, Inc., Form FD15, C.N. No. 83044, Aug. 5, 1999, retrieved from www.zurn.com, 2003.

Body Assembly specification sheet for Z415B Zurn floor drain, Rev. G, C.N. No. 92376, Jul. 15, 2004, retrieved from www.zurn.com, 2003.

* cited by examiner

FLOOR DRAIN SUPPORT PLATE

CROSS-REFERENCE TO RELATED APPLICATION

This application is a continuation of U.S. patent application Ser. No. 11/012,894, filed Dec. 15, 2004, which claims priority to U.S. Provisional Patent Application No. 60/532,058, filed Dec. 23, 2003. The entire contents of the above-reference applications are incorporated herein by reference.

BACKGROUND OF THE INVENTION

1. Field of the Invention

The present invention relates to floor drains and, more particularly, to a floor drain support plate.

2. Description of Related Art

Presently, floor drains are initially installed utilizing a drain body that can receive either a clamp collar, which receives either a dome or frame, or a frame which also serves as a clamp collar for receipt of a grate. Such prior art floor drain arrangements are manufactured, for example, by Zurn Industries, Inc.

Referring to FIGS. 1 and 2, a typical prior art floor drain 10 includes a receptacle body 12 having a first end 14 and a pipe receiving second end 16 and defining a body cavity 20. The first end 14 of the body 12 includes an annular flange 22 extending away from the cavity 20 of the receptacle body 12. A plurality of spaced apart protrusions 24, preferably four (two are shown and two on an opposite side are not shown in FIGS. 1 and 2), are defined adjacent the first end 14 of the receptacle body 12 underneath the flange 22 and extending in a direction away from the cavity 20 of the receptacle body 12. Each protrusion 24 defines a passageway 26 which can be internally threaded and adapted to receive a fastener F (shown in phantom in FIG. 1). The second end 16 of the receptacle body 12 is adapted to fasten to a drain pipe P (shown in phantom in FIG. 2).

FIGS. 1 and 2 also show a prior art method of installing a prior art floor drain 10 in a floor structure. First, a bore is cut in a block S, preferably made of Styrofoam®, and the second end 16 of the receptacle body 12 is placed within the bore of the block S (shown in FIG. 1). The block S is then placed on a wooden board B, such as plywood, and a wire W is wrapped around the receptacle body 12 and secured to the board B via a nail N, as shown in FIG. 1. Referring to FIG. 2, concrete C is then poured around the receptacle body 12 and the block S and allowed to set. The board B is then removed from underneath the floor structure and the block S is chiseled away from the concrete C, thereby creating a void V between the concrete C and the second end 16 of the receptacle body 12. The wire W is left embedded in the concrete C and any protruding wires W or nails N are trimmed.

One drawback to the prior art floor drain installation is that the height H (shown in FIG. 1) between the first end 14 of the receptacle body 12 and the board B cannot be adjusted without either cutting the block S or replacing the block S with a larger block. Another drawback to the prior art method is that installation time is increased because the block S has to be chiseled away from the embedded concrete C.

Therefore, it is an object of the present invention to overcome the above-mentioned drawbacks by providing an adjustable floor drain arrangement that is easy to install.

SUMMARY OF THE INVENTION

The present invention provides for a drain support plate adapted to fasten to a receptacle body of a drain. The support plate includes a body having an inner surface and a outer surface and defining a first portion and a second portion. The first portion of the body defines a peripheral edge and the second portion of the body is attached to the peripheral edge of the first portion and axially extends therefrom. The inner surface of the first portion and the second portion of the body define an interior cavity. The first portion of the body defines a center passageway spaced radially apart from the peripheral edge and is adapted to receive a pipe. The first portion of the body also defines at least one slot adapted to be aligned with the receptacle body for receiving a member for attaching the receptacle body to the body of the support plate. At least one score line may also be defined on the first portion adjacent the center passageway of the body of the support plate.

The present invention also provides for a drain support plate assembly that includes a receptacle body of a drain and a drain support plate as previously discussed. The receptacle body includes a first end and a second end, wherein the first end of the receptacle body defines at least one passageway adapted to receive a fastener and the second end of the receptacle body is adapted to fasten to a pipe. The support plate having a body is attached to the receptacle body via a member for attaching the receptacle body to the body through the slot in the first portion of the body and the receptacle body. The drain support plate assembly further includes a pipe connection attached to the second end of the receptacle body, wherein the pipe connection extends through the center passageway of the body of the support plate. The pipe connection is adapted to fasten to a drain pipe. A pipe spacer may also be positioned around the second end of the receptacle body, wherein the pipe spacer extends from the second end of the receptacle body toward the body of the support plate.

The present invention provides for a method of installing a drain in a floor structure. The method includes the steps of providing a receptacle body of a drain and a drain support plate as previously discussed. Next, the receptacle body of the drain is attached to the first portion of the support plate via a member for attaching the receptacle body to the body through the slot in the first portion of the body and the receptacle body. Lastly, the support plate with the attached receptacle body is installed in a floor structure.

DETAILED DESCRIPTION OF THE INVENTION

Figure 1:
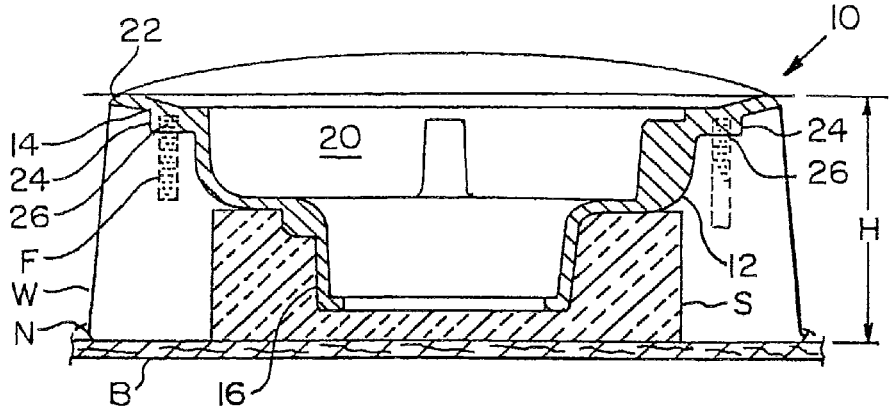
FIG. 1 (PRIOR ART)
FIG. 1 is a partial cross-sectional view of a prior art floor drain installation.
Figure 2:
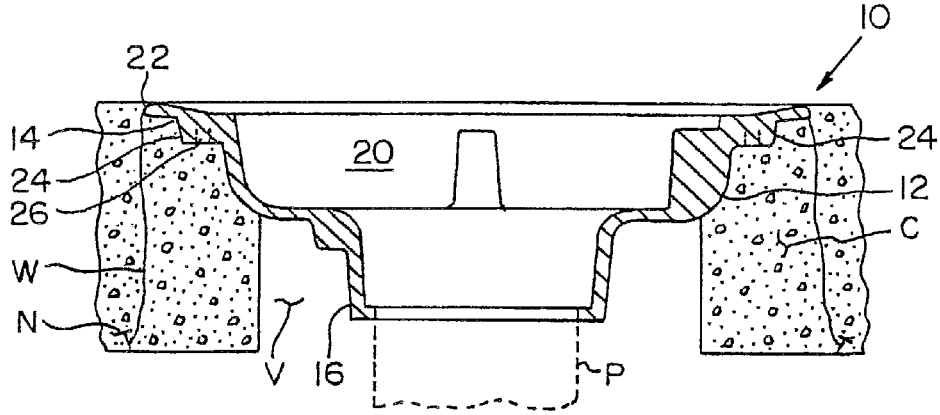
FIG. 2 (PRIOR ART)
FIG. 2 is a partial cross-sectional view of the prior art floor drain installation shown in FIG. 1 embedded in concrete.
Figure 5:
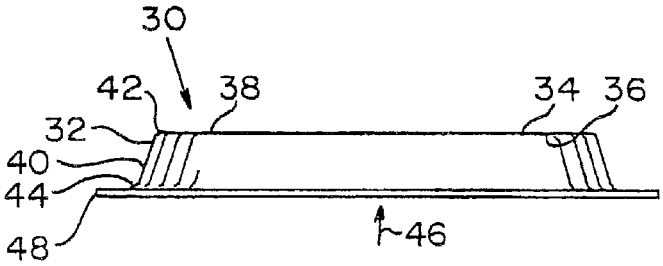
FIG. 5 is side elevational view of the drain support plate shown in FIG. 3.
Figure 3:
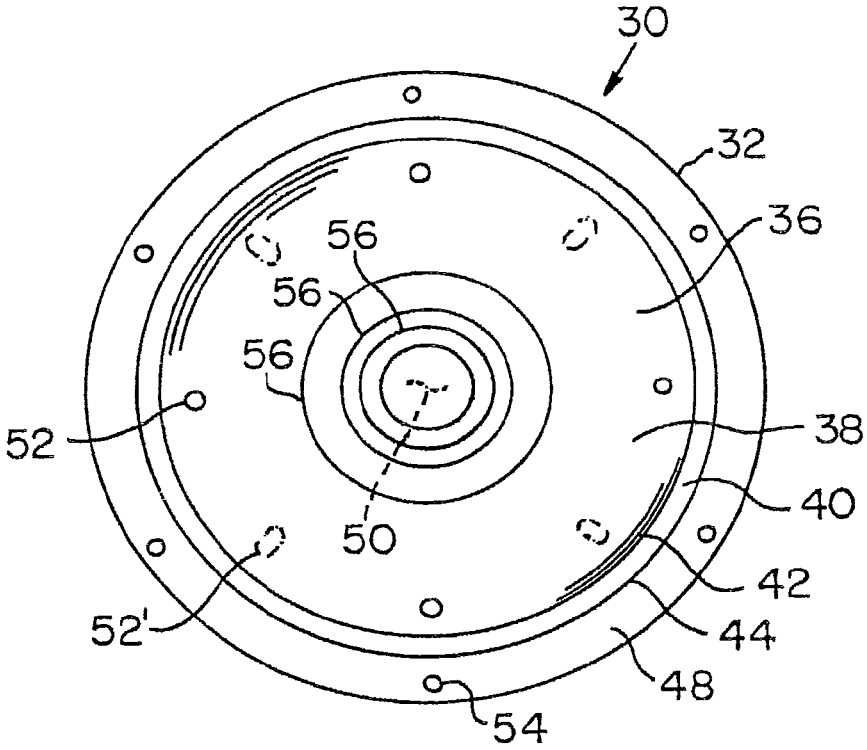
FIG. 3 is a bottom plan view of the drain support plate made in accordance with the present invention.
Figure 4:
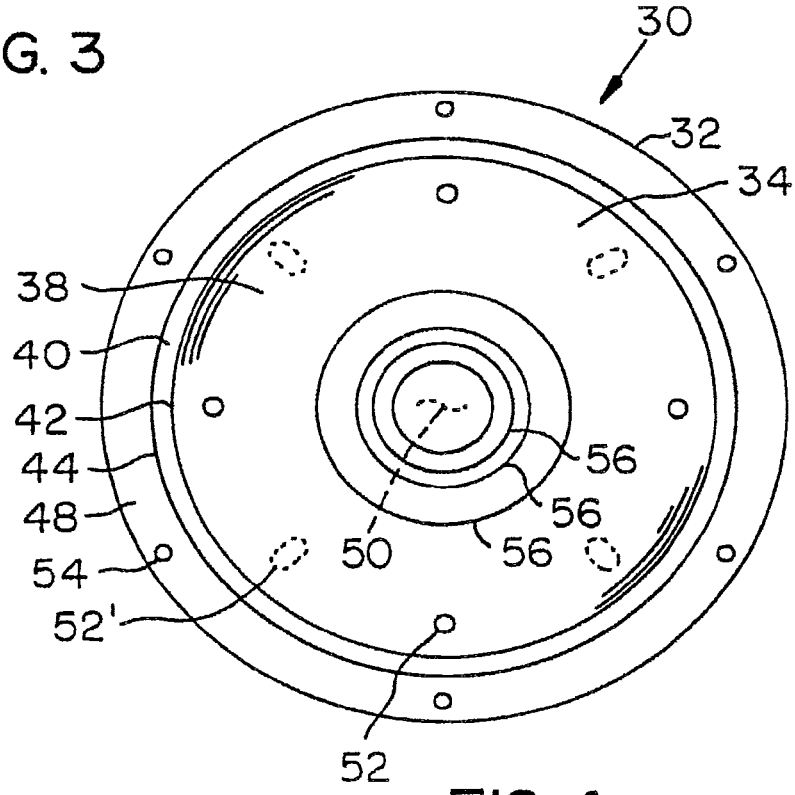
FIG. 4 is a top plan view of the drain support plate shown in FIG. 3.
Figure 6:
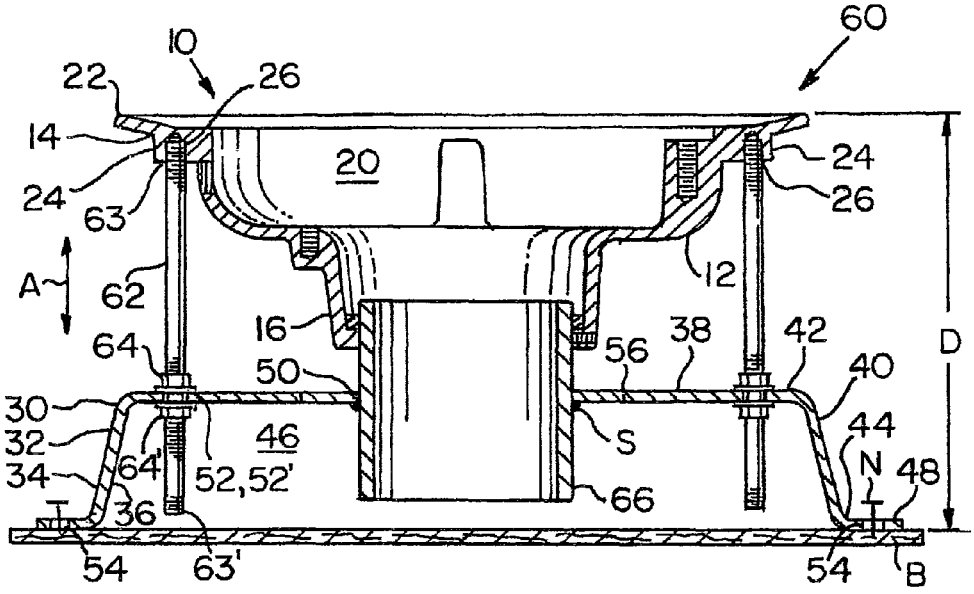
FIG. 6 is a partial cross-sectional view showing a floor drain installation made in accordance with the present invention utilizing the drain support plate shown in FIG. 3.
Figure 7:
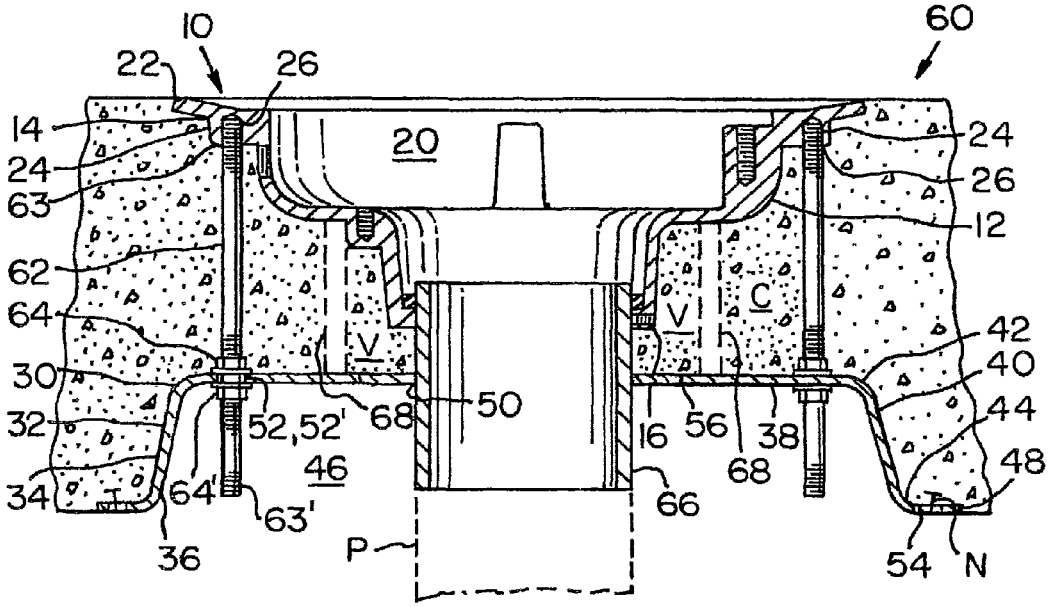
FIG. 7 is a partial cross-sectional view of the floor drain installation shown in FIG. 6 embedded in concrete.

Referring to FIGS. 3, 4 and 5, the present invention provides for a floor drain support plate 30 that can adapt to fasten to a receptacle body 12 of a prior art floor drain 10 as shown in FIGS. 6 and 7. The support plate 30 includes a body 32 having an outer surface 34 and an inner surface 36 and defining a first portion 38 and a second portion 40. The first portion 38 of the body 32 is preferably disc shaped and defines a peripheral edge 42. The second portion 40 of the body 32 defining an edge 44 is attached to the peripheral edge 42 of the first portion 38 of the body 32 and axially extends therefrom, wherein the inner surface 36 of the body 32 defines an interior cavity 46 (shown in FIGS. 6 and 7). An annular flange 48 is attached to the edge 44 of the second portion 40 and extends in a direction away from the interior cavity 46 of the body 32 of the support plate 30 (shown in FIG. 5). The first portion 38 of the body 32 may define a center passageway (50 shown in phantom) spaced radially apart from the peripheral edge 42. The center passageway 50 can vary in size and shape in order to accommodate various sizes and shape of pipe. The first portion 38 of the body 32 can also define a plurality of slots 52, (52' shown in phantom in FIGS. 3 and 4) adjacent the peripheral edge 42, wherein the slots 52, 52' are adapted to receive a fastener 62 for securing the support plate 30 to the receptacle body 12 of the floor drain 10 as shown in FIGS. 6 and 7. The slots 52, 52' can vary in size, shape, and number in order to accommodate different size and shape floor drains. The slots 52' can be positioned around a circle having a different radius than a circle on which slots 52 are positioned, wherein the circles are coaxial with each other. The flange 48 also defines a plurality of flange slots 54 (preferably four) adapted to receive a fastener, such as a nail N, for securing the support plate 30 to a board B (shown in FIGS. 6 and 7). The body 32 of the support plate 30 can be made of a unitary piece of metal or plastic.

Referring back to FIGS. 3 and 4, the first portion 38 of the body 32 of the support plate 30 can include a plurality of score lines 56 defined on the inner surface 36 and/or outer surface 34 adjacent the peripheral edge 42 of the body 32 of the support plate 30. The score lines 56 can vary in size and shape in order to accommodate different size and shape pipe. The first portion 38 of the body 32 of the support plate 30 may or may not have a center passageway 50. When the support plate 30 includes a center passageway 50, the score lines 56 are defined adjacent the center passageway 50. When a section of the first portion 38 of the body 32 of the support plate 30 is removed along one of the score lines 56, a center passageway 50 is either formed, or increased in diameter in order to accommodate various size pipe. Alternatively, the appropriate section defined by one of the score lines 56 can be cut or punched out. Further, the body 32 of the support plate 30 need not include any score lines 56.

FIGS. 6 and 7 show a floor drain support plate assembly 60 that includes a prior art floor drain 10 attached to a support plate 30 as previously discussed via a fastener 62, wherein the support plate 30 extends a distance D below the protrusion 24 of the receptacle body 12. A first end 63 of the fastener 62 is received within the passageway 26 of the protrusion 24 in the receptacle body 12. A second end 63' of the fastener 62 passes through slot 52 or 52' in the first portion 38 of the body 32 of the support plate 30, wherein a first flange nut 64 is positioned on the fastener 62 adjacent the outer surface 34 of the body 32 of the support plate 30 and a second flange nut 64' is positioned adjacent the inner surface 36 of the body 32 of the support plate 30. The fastener 62 preferably is a threaded fastener that can be threadably received within the passageway 26 of the protrusion 24 in the receptacle body 12. However, it is contemplated that fastener 62 can be formed in the receptacle body 12 for engagement with slots 52, 52' for attaching the receptacle body 12 to the support plate 30. The distance D (shown in FIG. 6) between the receptacle body 12 and the support plate 30 can be adjusted by longitudinally moving the nuts 64, 64' along the fastener 62.

With continued reference to FIGS. 6 and 7, the support plate assembly 60 further includes a pipe connection 66 attached to the second end 16 of the receptacle body 12, wherein the pipe connection 66 extends through the center passageway 50 of the body 32 of the support plate 30. The pipe connection is adapted to fasten to a drain pipe P (shown in phantom in FIG. 7). A pipe spacer 68 (shown in phantom in FIG. 7) may also be positioned around the second end 16 of the receptacle body 12, wherein the pipe spacer 68 is spaced from the second end 16 of the receptacle body 12 and extends toward first portion 38 of the body 32 of the support plate 30.

The present invention provides for a method of installing a prior art floor drain 10 in a floor structure utilizing the support plate 30 as previously discussed. First, the size of a drain pipe is determined, such as 2", 3", 4", or 6" pipe, and the support plate 30 having a center passageway 50 corresponding to the size and shape of the drain pipe is provided. Alternatively, a section of the first portion 38 of the body 32 of the support plate 30 can be removed along a score line 56 (shown in FIGS. 3 and 4) corresponding to the size of the pipe, thereby forming or increasing the size of the center passageway 50. Second, the passageway 26 in each protrusion 24 of the receptacle body 12 is aligned with a respective slot 52 or 52' in the first portion 38 of the body 32 of the support plate 30, and a fastener 62 is used to attach the receptacle body 12 to the support plate 30. For attachment to occur, a first flange nut 64 is fastened onto the fastener 62 and a first end 63 of the fastener 62 is received within the passageway 26 of the protrusion 24 of the receptacle body 12. A second end 63' of the fastener 62 then passes through a slot 52 or 52' in the support plate 30, wherein the first flange nut 64 abuts against the outer surface 34 of the first portion 38 of the body 32 of the support plate 30. A distance D between the receptacle body 12 and the support plate 30 can be increased or decreased by longitudinally moving the first flange nut 64 in either direction represented by arrow A along the fastener 62 (shown in FIG. 6). Once the distance D is determined, a second flange nut 64' is fastened onto the second end 63' of the fastener 62 and moved toward the inner surface 36 of the body 32 of the support plate 30, thereby fixing the distance D between the receptacle body 12 and the support plate 30. The distance D can still be adjusted by longitudinally moving both flange nuts 64, 64' along the fastener 62. Third, a pipe connection 66 can be connected to the second end 16 of the receptacle body 12, wherein the pipe connection 66 extends through the center passageway 50 of the body 32 of the support plate 30 and can be adapted to be used to attach future pipe P (shown in phantom in FIG. 7). A sealant S (shown in FIG. 6), such as rubber or foam, can be placed between the pipe connection 66 and the center passageway 50 of the support plate 30 in order to fill in any gap that may exist. However, a pipe connection 66 does not have to be installed in order for a future pipe to be connected to the second end 16 of the receptacle body 12. Fourth, the support plate 30 is then fastened to a board B via a fastener, such as a nail N, passing through a flange slot 54 in the flange 48 of the body 32 of the support plate 30, as shown in FIG. 6. Referring to FIG. 7, concrete C is then poured around the receptacle body 12 and the support plate 30, wherein the support plate 30 prevents any concrete C from contacting the pipe connection 66 within the interior cavity 46 of the body 32 of the support plate 30, thus creating an empty space. The empty space created in the underside of the concrete slab allows for a future pipe P (shown in phantom) to be attached to the pipe connection 66 after the concrete is poured. A pipe spacer 68 (shown in phantom in FIG. 7) may also be positioned around the second end 16 of the receptacle body 12, wherein the pipe spacer 68 is spaced from the second end 16 of the receptacle body 12 and extends toward the first portion 38 of the body 32 of the support plate 30. The pipe spacer 68, which can be a plastic pipe, prevents the concrete C from contacting a section of the pipe connection 66 above the support plate 30, thus creating a void V. In the case of a void V the concrete shown in FIG. 7 positioned radially inwardly from the pipe spacer 68 would not be present and the void V would be defined between the pipe spacer 66, a portion of the receptacle body 12, a portion of the pipe connection 60, and a portion of the support plate 30. This void V allows the pipe connection 66 to be removed without chiseling away at the concrete C. Once the concrete C is cured, the board B is then removed from the underside of the floor structure. The second end 63' of the fasteners 62 and nails N can be later trimmed.

An advantage of the support plate assembly 60 is that an installer can level and adjust the floor drain 10 to the required height prior to pouring the concrete. Further, the support plate 30 also prevents the location of the floor drain 10 from becoming altered (such as from being kicked or stepped on) prior to pouring the concrete.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A drain support plate assembly comprising:

a receptacle body of a drain, said receptacle body having a first end and a second end, said second end of said receptacle body adapted to fasten to a pipe; and a drain support plate having a body defining a first portion and a second portion, said body having an inner surface and an outer surface, said first portion of said body defining a peripheral edge, said second portion of said body attached to the peripheral edge of said first portion, said second portion extending axially from said first portion in a direction opposite from the first end of said receptacle body, said first portion of said body defining a center passageway spaced radially apart from the peripheral edge and adapted to receive a pipe, the second end of said receptacle body axially spaced from said center passageway by a distance, said distance being adjustable, wherein said drain support plate is attached to said receptacle body via a member extending between said receptacle body and said support plate body, said first portion of said body of said drain support plate defining an opening positioned between the peripheral edge and the center passageway that receives a portion of said member.

2. The drain support plate assembly as claimed in claim 1, wherein said first end of said receptacle body includes at least one protrusion extending away from the receptacle body for coacting with said member.

3. The drain support plate assembly as claimed in claim 2, wherein the member coacts with a passageway in said at least one protrusion of said receptacle body.

4. The drain support plate assembly as claimed in claim 1, wherein said member is a threaded fastener secured to said support plate body via a nut.

5. A method of installing a drain in a floor structure, said method comprising the steps of:

a) providing a receptacle body of a drain, said receptacle body having a first end and a second end, said second end of said receptacle body adapted to fasten to a pipe;

b) providing a drain support plate having a body defining a first portion and a second portion, said body having an inner surface and an outer surface, said first portion of said body defining a peripheral edge, said second portion of said body attached to the peripheral edge of said first portion, said second portion extending axially from said first portion in a direction opposite from the first end of said receptacle body, said first portion of said body defining a center passageway spaced radially apart from the peripheral edge and adapted to receive a pipe;

c) attaching said receptacle body of said drain to said first portion of said drain support plate via a member, wherein the second end of said receptacle body is axially spaced from said center passageway by a distance, said distance being adjustable, and wherein said first portion of said body of said drain support plate defines an opening positioned between the peripheral edge and the center passageway that receives a portion of said member; and d) installing said drain support plate with said attached receptacle body in a floor structure.

6. The method of claim 5, wherein said first end of said receptacle body includes at least one protrusion extending away from the receptacle body for coacting with said member.

7. The method of claim 6, wherein the member coacts with a passageway in said at least one protrusion of said receptacle body.

8. The method of claim 5, wherein said member is a threaded fastener secured to said support plate body via a nut.

* * * * *

UNITED STATES PATENT AND TRADEMARK OFFICE

CERTIFICATE OF CORRECTION

PATENT NO. : 8,146,308 B2
APPLICATION NO. : 12/904370
DATED : April 3, 2012
INVENTOR(S) : Lawrence Warnecke et al.

It is certified that error appears in the above-identified patent and that said Letters Patent is hereby corrected as shown below:

Title page, Column 1, Item (*) Notice:, Lines 5-6, delete "This patent is subject to a terminal disclaimer."

Signed and Sealed this
Thirty-first Day of July, 2012

David J. Kappos

David J. Kappos
*Director of the United States Patent and Trademark Office*